United States Patent [19]

Brackmann et al.

[11] Patent Number: 4,967,770

[45] Date of Patent: Nov. 6, 1990

[54] CIGARETTE MAKING MACHINE HOPPER

[75] Inventors: Warren A. Brackmann; Stanislav M. Snaidr, both of Mississauga; Takeshi Nehyo, Willowdale; Michael H. Sheahan, Toronto, all of Canada

[73] Assignees: Rothmans, Benson & Hedges Inc.; Rothmans International Services Limited, Toronto, Canada

[21] Appl. No.: 357,301

[22] Filed: May 26, 1989

Related U.S. Application Data

[62] Division of Ser. No. 190,122, May 4, 1988, Pat. No. 4,867,180.

[51] Int. Cl.[5] ..... A24B 1/02

[52] U.S. Cl. ..... 131/109.1; 131/84.1; 131/109.2; 131/84.3

[58] Field of Search ..... 131/108, 109.1, 109.2, 131/109.3, 110, 84.1, 84.2, 84.3, 84.4

[56] References Cited

U.S. PATENT DOCUMENTS

| | | | |
|---|---|---|---|
| 4,090,521 | 5/1978 | Elsner | 131/108 |
| 4,172,515 | 10/1979 | Wochowski | 131/108 X |
| 4,499,909 | 2/1985 | Seragnoli | 131/108 X |
| 4,524,781 | 6/1985 | Seragnoli | 131/108 |
| 4,627,447 | 12/1986 | Brackmann et al. | 131/109.2 X |
| 4,802,497 | 2/1989 | Hrboticky | 131/108 X |

*Primary Examiner*—V. Millin
*Assistant Examiner*—Jennifer L. Doyle
*Attorney, Agent, or Firm*—Sim & McBurney

[57] ABSTRACT

Degradation of tobacco brought about by refuser and recycle procedures in conventional cigarette-making machine operations is eliminated by feeding, metering and opening tobacco from a reservoir directly onto the external surface of a rotary or rectilinear transportation device which conveys the tobacco to rod formation. Specific modifications to the Molins Mark IX and Hauni Protos cigarette-making machines are described.

13 Claims, 2 Drawing Sheets

CIGARETTE MAKING MACHINE HOPPER

This is a division of application Ser. No. 190,122 filed May 4, 1988 now U.S. Pat. No. 4,867,180.

FIELD OF INVENTION

The present invention relates to cigarette-making machines, in particular, to mechanisms and procedures for forming feed streams therein.

BACKGROUND TO THE INVENTION

In the conventional manufacture of cigarettes, a tobacco filler rod is formed by moving an air-permeable collecting surface transverse to a vertically-moving thin shower of tobacco, collecting the tobacco thereon to build up a tobacco filler rod across the width of the shower, and wrapping a paper web around the tobacco filler rod. In general, two systems are in commercial use, one wherein the vertically-moving thin shower passes upwardly into engagement with the collecting tape and the other wherein the shower falls downwardly onto the collecting tape.

Upstream of the location of the vertically-moving thin shower a variety of structures and operations have been adopted to form a wide stream or carpet of tobacco from which the shower is formed. Cut tobacco is received by the cigarette-making machine onto a hopper and tobacco is manipulated within the machine by a variety of procedures to form the aforementioned wide carpet. In each of these procedures some form of metering of tobacco occurs, often combined with internal recycle of tobacco, which causes degradation of the tobacco and impairing of filling power. In addition, tobacco often is provided to the hopper in a somewhat unopened form as a result of the procedures used to convey tobacco from cutting operations to the cigarette-making machine, so that the metering operations often lead to further degradation of the tobacco.

One such prior art arrangement is the so-called Molins Mark IX machine. In such machine, following manipulation of the tobacco from the hopper to open it, tobacco is removed from the reservoir of such opened tobacco by a rotary carding drum as a wide stream of tobacco particles, the wide stream then is passed adjacent a second counter-rotating carding drum, which cooperates with the first carding drum to limit the quantity of tobacco in the wide stream by a refusing action.

Another such machine, the so-called Hauni Protos machine, tobacco is transported from a hopper by a lifting conveyor which has a metering device in the form of a refiner associated therewith. From the top of the lifting conveyor tobacco is fed to a downward chute onto the outer surface of a transport roller in the form of a carding drum. A picker roll then picks the tobacco from the surface of the transport roller onto the upper surface of a transport conveyor on which the tobacco is fed to a filler rod-forming mechanism.

In copending U.S. patent application No. 863,009 filed May 14, 1986 (now U.S. Pat. No. 4,754,765), assigned to the assignee hereof and the disclosure of which is incorporated herein by reference, there are described modifications to the Molins Mark IX machine and the Hauni Protos machine, wherein a novel hopper and transportation arrangement is provided which by passes the internal hopper arrangement, introduces a wide stream of particles to the carding drum and the conveyor respectively which then act solely as transportation devices to rod formation. There is no internal tobacco recycle nor refuser operations, thereby avoiding the tobacco degradation that results therefrom.

In U.S. Pat. No. 4,459,999 also assigned to the assignee herein, the disclosure of which is incorporated herein by reference, there is described a cigarette-making operation wherein a reservoir of tobacco is metered and opened to form a tobacco feed stream from which a filler rod is directly formed.

SUMMARY OF INVENTION

In accordance with the present invention, the modifications to the Molins Mark IX machine and Hauni Protos machine described in the aforementioned U.S. patent application Ser. No. 863,009 are further improved upon by completely rebuilding the hopper arrangement so that the tobacco particles from the metering and opening device are fed directly onto the external surface of the carding drum, which simply acts as a rotary tobacco-conveying device, in the case of the Mark IX machine, and directly on the surface of the feed conveyor, in the case of the Protos machine.

In one embodiment, the conventional second carding drum may be used in the Mark IX machine but positioned with respect to the transportation surface of the first carding drum so as to sense, engage and open only tobacco requiring opening (typically less than 1% of the tobacco), usually in the form of clumps, while the remainder of the tobacco is unaffected and is transported on the external surface of the carding drum. In this way, the tobacco may be redistributed or scattered to average out the "shadows" or thin spots which typically follow tobacco clumps, thereby decreasing the degree of trimming of tobacco which is required.

Alternately, redistribution or scattering of clumps may be effected in both the Mark IX and Protos machine by providing clump sensing devices adjacent the wall of the tobacco metering and opening device to sense, engage and open clumps on the wall. The degree of sensing required can be varied by making the distance between the wall and the sensing devices adjustable.

The present invention enables the construction and operation of existing cigarette-making machines of the type which have a rotary tobacco-conveying device or a rectilinear tobacco-conveying device to which a wide opened stream of tobacco produced by a non-refusing hopper arrangement can be introduced, to be improved and simplified and the principles thereof may be incorporated into new machine designs. The present invention results in the production of cigarette filler rods of improved quality with decreased degradation of tobacco.

GENERAL DESCRIPTION OF INVENTION

Figure 1:
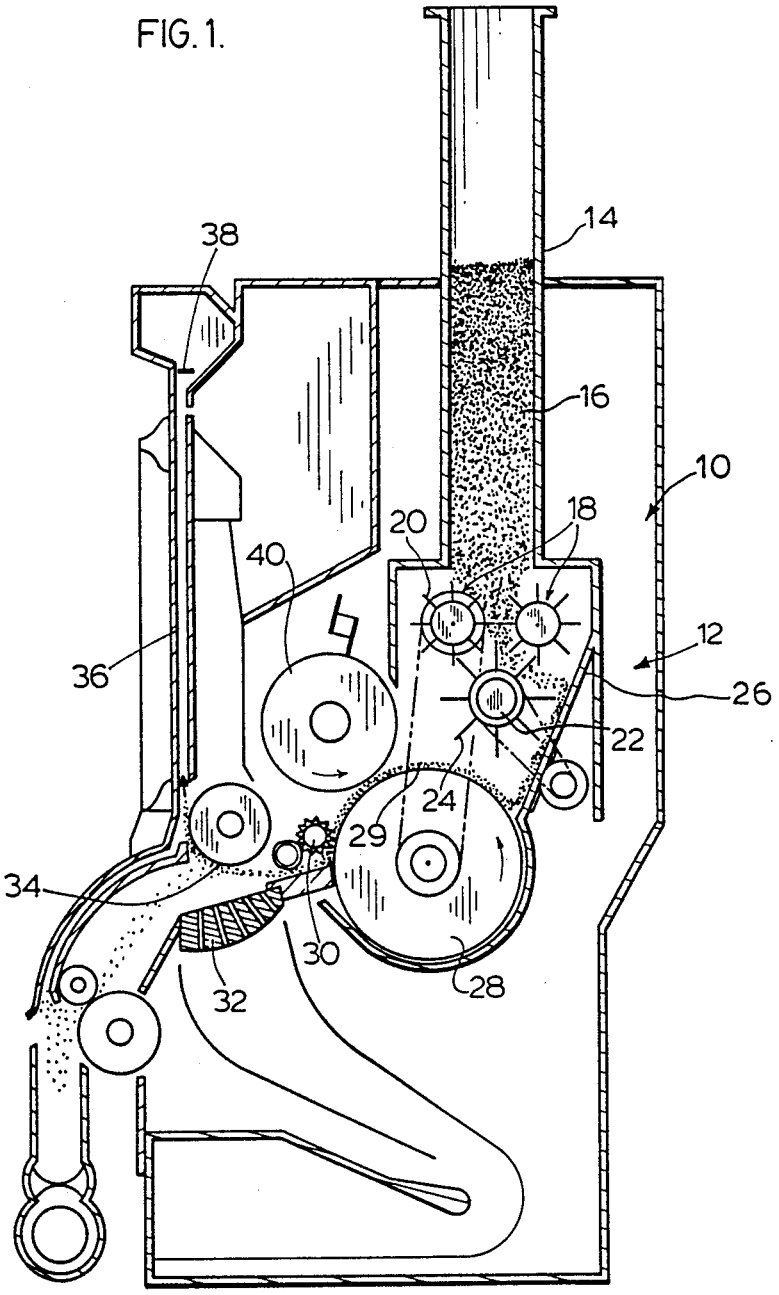
FIG. 1 is a schematic representation of a Molins Mark IX cigarette-making machine modified in accordance with one embodiment of the invention.

In the present invention, tobacco is metered from a source of tobacco contained in a reservoir, the metered tobacco is opened to separate the tobacco particles one from another, and a wide carpet of opened tobacco particles is formed from all the individual separated tobacco particles on the external surface of a rotary or rectilinear tobacco-conveying device and is transported on the tobacco-conveying device to provide feed to the shower-forming operation while maintained in their opened condition. The quantity of tobacco forming the wide tobacco carpet from which the filler rod ultimately is formed is controlled by the rate of metering from the reservoir directly onto the external surface of the tobacco-conveying device, so that no refuser roll or additional metering means is required at a downstream location. The tobacco-conveying device is rotary, typically a carding drum, in application of the present invention to the Molins Mark IX cigarette-making machine while the tobacco-conveying device is rectilinear in application of the present invention to the Hauni Protos cigarette-making machine.

The reservoir preferably comprises an upright housing of rectangular cross-section which receives tobacco through an open top thereof to provide a mass of tobacco therein. The metering of tobacco from this mass is effected using a pair of counter-rotating rollers located at the bottom of the housing on parallel axes and which have radial pins projecting therefrom which interact to grip tobacco therebetween and provide a downward metered flow from the tobacco mass contained in the reservoir, at a rate corresponding to the rate of rotation of the rollers. Opening of the metered flow of tobacco particles is effected using a third roller located below the counter-rotating rollers on an axis parallel to and substantially equidistantly from the axes of the pair of rollers. The third roller has pins which project from the surface thereof to interdigitate with those of the counter-rotating rollers. The interaction of the pins in this way results in separation of the metered flow of tobacco particles one from another with a minimum of damage thereto and the formation thereby of an opened mass of tobacco particles. The reservoir may be considered to be a "flow-through" hopper, in which all tobacco fed thereto is used in rod formation.

As the particles are discharged from the third roller, they are received as a wide carpet of tobacco directly onto the external surface of a tobacco-conveying device for transportation to the shower-forming operation of the cigarette-making machine, so that the particles remain in an opened condition in the wide carpet of tobacco and reach the shower-forming operation in this condition.

The manner of effecting the shower-forming operation within the cigarette-making machine depends on the specific machine-type to which the invention is being applied. Typically, such shower-forming operation involves transportation of the wide carpet of tobacco on the tobacco-conveying device and removal of the individual tobacco particles of the carpet from the downrunning side or downstream side of the transportation device, often under the influence of air, to form the tobacco particle shower, either in an upwardly-flowing, for example, in the case of both the Molins Mark IX machine and the Hauni Protos machine, or in a downwardly-flowing direction, often in association with a winnowing operation to remove unwanted heavy particles.

In this procedure, therefore, the tobacco in the reservoir is metered, opened and transported to shower formation and thence to filler rod formation without any refuser operation or recycle of tobacco, thereby avoiding the tobacco degradation that occurs in conventional cigarette-making machine operations.

The present invention is utilized as a retrofit modification to existing cigarette-making machine operations, all internal metering and refuser operations of the machine are removed and a metered and opened flow of tobacco particles is delivered by the existing carding drum (but with its refuser drum removed from a refuser location) or rectilinear conveyor to the location of shower formation in the machine. The quality of tobacco which flows to the shower from which the filler rod is formed, therefore, is controlled by metering from the reservoir and not by any internal machine flow control device.

The cut tobacco may be fed to the reservoir thereof by any procedure. For example, tobacco may be transported from a remote source by a flowing air stream drawn under the influence of vacuum and accumulated in a suitable hopper located above the open top of the reservoir. The transporting air flow is shut off from time to time to permit the accumulated tobacco mass to be dumped from the hopper to the reservoir.

Alternatively, a continuous feed of separated tobacco particles may be provided to the reservoir by transportation under the influence of a flowing air stream drawn under the influence of vacuum from a remote location. A rotary air lock may be used in place of the discontinuous discharge hopper at the top of the reservoir, so as to discharge tobacco continuously or discontinuously from the transportation line to the reservoir, which then is maintained at the ambient atmospheric pressure.

In addition, the cut tobacco may be fed manually to reservoir or by any other convenient means.

The principles which are embodied in the modification of the existing cigarette-making machine structure and operation as described above, enable the provision of a novel form of cigarette-making machine which does not employ refuser mechanisms and which does not employ tobacco recycle, (except for tobacco trimmed from the filler rod). The reservoir of tobacco and associated metering rollers in combination with the opening roller is a simple and compact structure which eliminates all the complex hopper and metering systems used in modern cigarette-making machines and provides the considerable additional benefit that the tobacco degradation associated with conventional systems is avoided.

DESCRIPTION OF PREFERRED EMBODIMENT

Referring to FIG. 1, there is illustrated therein the application of the principles of the invention to a Molins Mark IX cigarette-making machine. The conventional tobacco hopper, tobacco metering conveyor with associated refuser roll, picker roll, and collection reservoir for picked tobacco are eliminated.

In place of this conventional structure, the modified Mark IX cigarette-making machine 10 includes a novel hopper arrangement 12. The hopper arrangement 12 comprises an upright rectangularly cross-sectioned reservoir tube 14 which holds a mass 16 of tobacco for feeding therefrom. The reservoir tube 14 is open at both its upper and lower ends and communicates at its upper end with a source of cut tobacco, such as may be air conveyed from a remote source under the influence of vacuum.

At the lower end, the reservoir tube 14 communicates with a pair of metering rollers 18 which are mounted to rotate on parallel axes and have radially-directed pins 20 to meter a flow of tobacco from the mass 16 contained in the reservoir tube 14. A third roller 22 is positioned to rotate on an axis substantially equidistantly positioned with respect to the axes of the rollers 18. The roller 22 has pins 24 which interdigitate with the pins 20 so as to open the metered flow of tobacco and separate the individual particles one from another.

The third roller 22 discharges a wide stream of opened particles onto a chute or inclined wall 26 down which the wide stream slides onto the periphery of a carding drum 28. The carding drum 28, which conventionally in a Mark IX machine is one of a pair of metering/refuser drums serves to transport a wide stream of opened tobacco 29 on its tobacco-conveying surface. The machine 10 also may be arranged so that the metering roller 22 rotates in the opposite direction to discharge the metered flow directly on the exterior of the carding drum 28.

The tobacco is picked from the downrunning side of the carding drum 28 by conventional pickers 30 which project the tobacco particles across an upwardly-flowing air stream discharged from an air-flow guide 32. Heavy particles by their momentum pass through the flowing air stream and are collected from stream 34 as rejects.

The lighter desired particles are transported by the flowing air stream into an upwardly-extending chimney 36 and into contact with the undersurface of a suction belt 38 moving transversely to the tobacco stream, so as to build up a tobacco filler rod along its length and from which cigarettes may be formed in conventional manner.

As may be seen, the carding drum 28 acts simply as a transporting device for the tobacco carpet received from the hopper 12 to deliver all the metered flow of opened tobacco to the chimney 36, to attain the benefits which flow therefrom, with the exception of the minor amount which is winnowed out in conventional manner.

As mentioned previously, an upper carding drum 40 may be positioned with respect to the lower carding drum 28 so as to sense and engage any lumps of tobacco in the carpet 29 as it is transported on the lower carding drum 28 but not the remainder of the tobacco in the carpet 29. The upper carding drum 40 sensing and engaging any such lump opens the lumps and smooths out the tobacco carpet 29. Only a few such lumps are present, typically less than 1% of the tobacco, but can cause downstream problems. Their elimination by operation of the selective carding drum 40, therefore, is beneficial, although the carding drum 40 may be omitted, if desired.

Figure 2:
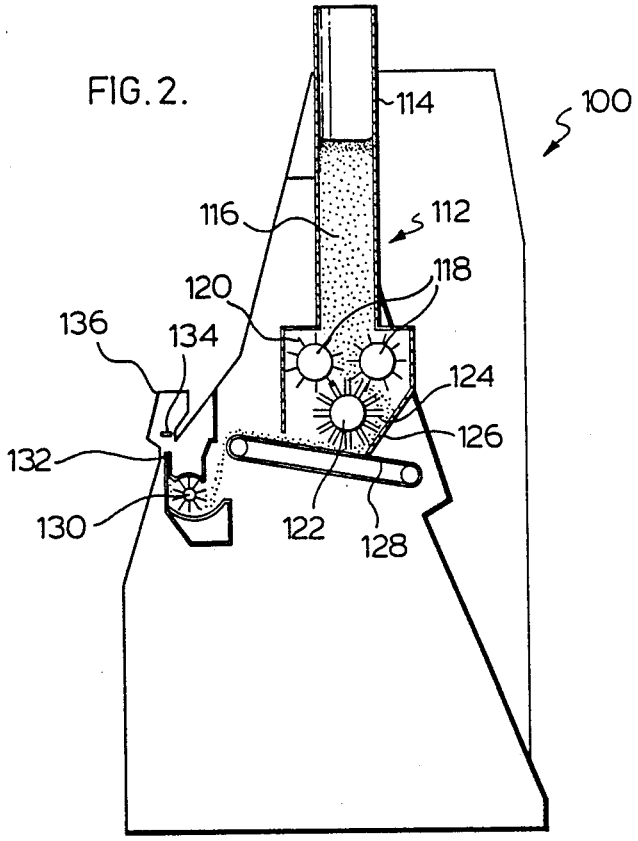
FIG. 2 is a schematic representation of a Hauni Protos cigarette-making machine modified in accordance with another embodiment of the invention.

Referring now to FIG. 2, there is shown therein the application of the principles of the present invention to the Hauni Protos cigarette-making machine. The conventional hopper, lifting conveyor with associated metering device, downward chute, transport roller and picker roll are eliminated.

In place of this conventional structure, the modified Protos cigarette-making machine 100 includes a novel hopper arrangement 112. The hopper arrangement 112 is similar to that illustrated in FIG. 1 for element 12 and comprises an upright rectangularly cross-sectioned reservoir tube 114 which holds a mass 116 of tobacco for feeding therefrom. The reservoir tube 114 is open at both its upper and lower ends and communicates at its upper end with a source of tobacco fed from a remote source by any convenient means.

At the lower end, the reservoir tube 114 communicates with a pair of metering rollers 118 which are mounted to rotate on parallel axes and have radially-directed pins 120 to meter a flow of tobacco from the mass 116 contained in the reservoir tube 114. A third roller 122 is positioned to rotate on an axis substantially equidistantly positioned with respect to the axes of the roller 118. The roller 122 has pins 124 which interdigitate with the pins 120 so as to open the metered flow of tobacco and separate the individual particles one from another.

The opened tobacco particles are directed onto a sloping wall 126 down which they slide as a wide stream of tobacco particles onto the upper surface of conveyor 128, which then transports the wide stream of opened tobacco particles on its surface to the conventional shower-forming mechanism 130 which forms an upwardly-flowing shower of tobacco particles in a chimney 132 for deposition on a rod-forming surface 134 through which vacuum is applied by a suction box 136. The tobacco, therefore, is passed from the reservoir tube/hopper 114 to rod-formation without any further refusal mechanism and hence avoids the tobacco degradation produced thereby.

Figure 3:
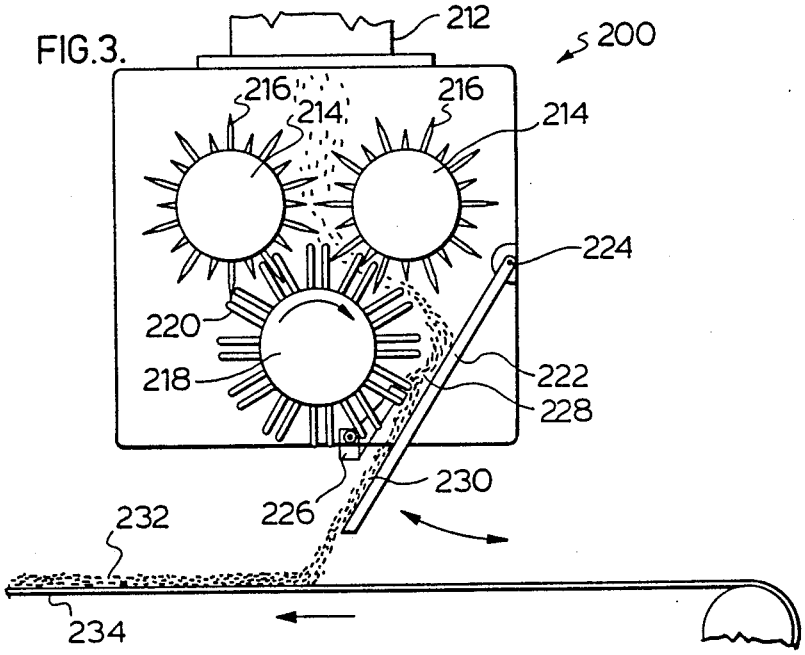
FIG. 3 is a close-up view of the three-wheel metering and opening device modified in accordance with another embodiment of the invention.

Referring to FIG. 3, there is shown therein a particular form 200 of the novel hopper arrangement 12 and 112 shown in FIGS. 1 and 2. This modified structure includes an upright rectangular reservoir tube 212, a pair of metering rollers 214 each having radial pins 216, and a third opening roller 218 also having radially-directed pins 220. The function and operation of the rollers 214 and 218 has been described above with respect to rollers 18 and 22 and rollers 118 and 122 and reference may be had to the above description of these elements.

An adjustable sloping wall 222 is provided pivoted at its upper end by pivot 224 so as to be positionable at a distance which is variable with respect to the pins 220. A series of fingers 226 is provided interdigitating with the pins 220 of the roller 218. The purpose of the fingers 226 is to sense any clumps 228 of tobacco in the wide opened tobacco stream 230 which is sliding down the wall 222 to form a wide stream of tobacco particles 232 on the upper surface of conveyor 234, such as the conveyor 128 shown in FIG. 2.

The clumps 228 engage the stationary fingers 226 and the radially-directed pins 220 and are broken up by the joint action of the pins 220 and the fingers 226. The adjustable positioning of the wall 222 with respect to the pins 220 enables the detection level for the clumps 228 to be adjustable. The fingers 226, therefore, act in analogous manner to the second upper carding drum 40 in the embodiment of FIG. 1 and may replace the same, in opening out only clumps 228 without affecting the remainder of the stream.

As previously mentioned, in view of the efficient metering and opening operation which is achieved using the metering and opening rollers, only a few such tobacco clumps 228 are present, typically less than 1% of the tobacco. This elimination using the combined effects of the fingers 226 and the pins 220 is beneficial in avoiding any downstream problems which such clumps may produce.

SUMMARY OF DISCLOSURE

In summary of this disclosure, the present invention provides novel methods and apparatus for improved cigarette filler rod formation by avoiding tobacco degradation procedures. Modifications are possible within the scope of this invention.

What we claim is:

1. In a method off forming a tobacco filler rod suitable for the formation of cigarettes, wherein a vertically-moving shower of cut tobacco particles is formed from a metered flow of cut tobacco and said filler rod is formed from said shower, the improvement which comprises:

providing said metered flow of cut tobacco particles by metering cut tobacco from a source of cut tobacco and opening said metered cut tobacco to separate the individual tobacco particles one from another, forming a wide stream of tobacco particles from all the individual separated tobacco particles on the external surface of a tobacco-conveying device by receiving said opened tobacco on a downwardly-sloping wall terminating adjacent to an external surface of said tobacco conveying device and transporting said opened tobacco to said tobacco-conveying device, sensing and opening clumps of tobacco in said opened tobacco on said wall without affecting the remainder of the tobacco in said wide stream, and transporting said wide stream of tobacco particles on said tobacco-conveying device to provide feed to the formation of said vertically-moving shower.

2. The method of claim 1 wherein said tobacco-conveying device is a rotary tobacco-conveying device.

3. The method of claim 1 wherein said tobacco conveying device is a rectilinear tobacco-conveying device.

4. The method of claim 1 wherein said source of cut tobacco is located in an upright tobacco reservoir zone having a tobacco receiving upper limit and a lower outlet from which the cut tobacco is metered.

5. The method of claim 4 wherein said reservoir zone has a generally rectangular cross section, said metering is effected by a cooperating pair of counter-rotating rollers having pins extending from the surfaces thereof so as to meter tobacco from the outlet, and said opening of said metered cut tobacco is effected by a third roller having pins extending from a surface thereof, so as to interact with the pins of the cooperating pair of rollers to open tobacco metered by the cooperating pair of rollers.

6. A cigarette-making machine, comprising:

an upright hopper for containing cut tobacco and having an upper inlet and a lower outlet, a pair of tobacco metering rollers located in communication with the hopper outlet for metering cut tobacco therefrom to form a metered flow of cut tobacco and a tobacco opening roller in operative relation to the pair of metering rollers to separate tobacco particles in said metered flow of cut tobacco one from another to provide opened tobacco, conveyor means located in juxtaposition to said opening roller for receiving said opened tobacco thereon and for transporting said opened tobacco as a wide stream of tobacco particles on the surface of said conveyor means, a sloping wall located adjacent said opening roller and extending downwardly to adjacent said conveyor means for receipt of said opened tobacco thereon and transportation to said conveyor means, sensing means for sensing and opening clumps of tobacco in said opened tobacco without adversely affecting the remainder of the tobacco in the opened tobacco, and tobacco shower-forming means for forming a vertically-moving shower of tobacco particles from said wide stream of tobacco particles transported by said conveyor means.

7. The cigarette-making machine of claim 6, wherein said conveyor means takes the form of a rectilinear conveyor.

8. The cigarette-making machine of claim 6, wherein the wall is arranged to permit the distance between the opening roller and the wall to be adjusted.

9. The cigarette-making machine of claim 6, wherein said sensing means comprise a plurality of sensing fingers extending between pins of said opening roller to engage clumps of tobacco on said wall.

10. A tobacco metering and opening device, comprising:

an upright hopper for containing cut tobacco and having an upper inlet and a lower outlet, a pair of tobacco-metering rollers located in communication with the hopper outlet each having pins extending from an outer surface thereof so as to meter cut tobacco therefrom to form a metered flow, a tobacco opening roller having pins extending from an outer surface thereof interdigitating with the pins of the metering rollers to separate tobacco particles in said metered flow one from another, a stationary sloping wall extending from above the opening roller adjacent the opening roller and terminating below the opening roller to receive said opened tobacco thereon and to transport the same on said surface, and a plurality of stationary pins extending between the pins of said opening roller adjacent said wall to sense, engage and open any clumps of tobacco in said opened tobacco on said wall without adversely affecting the remainder of the tobacco in the opened tobacco.

11. The cigarette-making machine of claim 10 wherein said hopper comprises a generally rectangularly cross-sectioned tube.

12. The apparatus of claim 10, wherein the wall is arranged to permit the distance between the pins of the opening roller and the wall to be adjusted.

13. The apparatus of claim 12, wherein the wall is pivoted at its upper end to permit such adjustment to be made.

* * * * *